United States Patent [19]

Kassner

[11] Patent Number: 4,829,633

[45] Date of Patent: May 16, 1989

[54] VEHICLE DOOR HINGE

[75] Inventor: Peter Kassner, Bochum, Fed. Rep. of Germany

[73] Assignee: Lunke & Sohn GmbH, Witten, Fed. Rep. of Germany

[21] Appl. No.: 94,446

[22] Filed: Sep. 9, 1987

[30] Foreign Application Priority Data

Oct. 15, 1986 [DE] Fed. Rep. of Germany ..... 8627459
Jul. 10, 1987 [EP] European Pat. Off. ..... 87109980

[51] Int. Cl.[4] ..... E05D 11/10

[52] U.S. Cl. ..... 16/322; 16/85; 16/332; 16/334; 16/340; 296/202

[58] Field of Search ..... 16/50, 85, 332, 334, 16/322, 276, 329, 340; 296/202

[56] References Cited

U.S. PATENT DOCUMENTS 1,612,237 12/1926 Thornton ..... 16/50
2,635,281 4/1953 Feldberg ..... 16/276
3,028,619 4/1962 Schlage et al. ..... 16/50 X
4,117,567 10/1978 Shimizu ..... 16/50

FOREIGN PATENT DOCUMENTS 647896 7/1937 Fed. Rep. of Germany .
3401252 7/1985 Fed. Rep. of Germany .
170363 10/1921 United Kingdom .

*Primary Examiner*—Nicholas P. Godici
*Assistant Examiner*—J. Reed Batten, Jr.
*Attorney, Agent, or Firm*—Banner, Birch, McKie & Beckett

[57] ABSTRACT

A door hinge for a vehicle door is provided with an integrated door check. One hinge member carries on its one end face a profile in the form of depressions, in which are inserted the retaining elements, e.g. in the form of balls, for a temporary arresting in predetermined positions. The balls are pressed down by a set of cup springs via a pressure plate or a ball bearing, so that there is a rolling movement of the retaining elements on the profile faces and on the pressure plate or ball bearing. The door check integrated into the door hinge is adjustable and/or readjustable with respect to its arresting force.

27 Claims, 2 Drawing Sheets

VEHICLE DOOR HINGE

BACKGROUND OF THE INVENTION

The invention relates to a vehicle door hinge, with a post member, a door member, a hinge pin pivotally connecting the two members, as well as a door check for temporarily arresting the door in at least one opening position, comprising a profile on one hinge member and at least one spring-loaded retaining or catch element held on the other hinge member or moved synchronously therewith which cooperates with the profile.

Such a door hinge is e.g. known from DE-OS No.34 01 252. On a given radius is provided on one hinge member a profile concentric to the hinge pin over which slides a resiliently mounted retaining element in the form of a pin with a rounded end. The pin and the profile are brought into engagement if, starting from a mounting and opening position outside the normal door opening range, the door hinge is brought into said door opening range.

In the case of certain vehicles the spatial conditions are so extreme, that a door opening over and beyond the normal opening range is not possible, or is only possible through damaging the body work. Thus, the known door hinge cannot be used in such cases. Another disadvantage is that only a single profile section and a single retaining element in the form of a pin are present for each arresting position. This leads to additional stressing or straining for the hinge pin. In addition, the overall arrangement must be made very robust, which causes an increase in the construction volume.

Finally, the pin guide and/or the pin are exposed to marked wear, because for each door movement considerable lateral forces act on the guide and are accompanied by the plunging movement.

THE PRESENT INVENTION

The object of the present invention is to so improve a door hinge of the aforementioned type, that its use is possible in the case of door opening angles not exceeding the normal opening range, that there is reduced stressing or straining of the hinge pin and that wear in particular of the profile and the retaining element, including its guide is markedly reduced.

According to the invention this object is met in that the profile comprises at least one depression in one end face of one hinge member, that the retaining element has rolling properties and is surrounded by a cage connected in non-rotary manner to the other hinge member and that each retaining element engages on a spring-loaded, freely rotatable pressure plate.

In the case of the door hinge according to the invention, the retaining element is constituted by a rollable body , e.g. in the form of balls, tapered rollers, short needles or cylindrical rollers, which are on the one hand guided and on the other hand are urged along by the cage. The retaining elements roll both on the end face provided with the profile in the shape of the depressions and on the pressure plate. As a result of these conditions, the pressure plate moves in the opposite direction by the same amount compared with the movably mounted hinge member. However, this phenomenon is of no significance. This leads to a particularly perfect arresting effect, which is not noticed in the zones between the arresting positions, i.e. the rolling friction virtually does not impede the opening movement of the door. This has been proved by measurements. Permanent testing has also revealed that the arresting forces remain constant over a very long period, following a short running-in time.

The cage for guiding and driving the retaining elements comprises in the simplest case a planar, hardened plate, which is turned on opening the door with respect to the profile in the form of depressions. Obviously the cage can be stationary and the profile can be turned, which is a function of the construction of the door hinge. As the retaining elements e.g. in the form of balls are much thicker than the cage, no forces act on the latter in the direction of the longitudinal axis of the hinge pin, apart from the rolling frictional forces of the retaining element on rolling into and out of the depressions of the profile. Thus, the cage can be associated in fixed manner with a hinge member or can be arranged movably in the direction of the longitudinal axis of the hinge pin.

The spring loading of the pressure plate can in particular be brought about by cup springs, which can be biased to different degress. Thus, the door hinge can be adapted to different doors or door layouts for the tarreting effect. In the case of heavy doors, a greater holding force is required than with light doors, because even in the case of a slight inclination of the vehicle about the transverse axis, the door must still be held in the arrested opening positions.

Tests have shown that the door hinge according to the invention still functions in troublefree manner if the retaining elements merely roll on the end face provided with the depressions and not also on the pressure plate. However, the free rotatability of the pressure plate is desirable and its rotation capacity pan e.g. be improved with respect to cup springs behind it with the aid of a supported TEFLON layer. Alternatively , the pressure plate can be constituted by one bearing ring of a ball bearing or the like, when a corresponding spring then rests on the other bearing ring. An axial ballbearing is particularly suitable for this purpose.

The retaining elements can be constituted by balls e.g. having a diameter of 3 mm or less, so that the space requirement per depression is less than 2 mm. Thus, it is possible on a hinge to juxtapose depressions with lateral angular distances of 7°. This gives a type of fine arresting, which is particularly advantageous under constricted parking conditions. There is then a very great probability that the corresponding door is also arrestable in approximately the maximum possible opening position, so that getting in and out can take place with maximum comfort. As a result of the rolling movement of the retaining elements, there is no noticeable impediment to the rapid overcoming of all the arresting positions on opening and closing the door into or out of wide opening positions.

In this configuration it is possible to use a particularly large number of retaining elements, so that the individual stressing or loading is very limited. However, even if in conventional manner, merely the maximum door opening position and an opening angle of approximately 45° is to be held by the arresting means, it is still easily possible to house three retaining elements on the circumference of the corresponding hinge member so that there is no special loading in the sense of a bending stress for the hinge pin. In addition, the specific pressure in and around the depressions can be kept small.

As in general there are two door hinges per vehicle door, both hinges are available for arresting and/or limiting the maximum door opening, whereby the most varied configurations are possible. Apart from an identical construction of both hinges with arresting and end stop in the maximum door opening position, said functions can also be attributed to one or the other of these. However, if the end stop is formed on one or both hinges in conjunction with door arresting, then the corresponding depression or depressions are provided with a deep step over which the retaining element cannot roll and which then forms the end stop. However, more robust is an end stop in conventional manner with the aid of a nose or the like on one hinge member which engages on a corresponding stop face of the other hinge member in the end position.

A door hinge according to the invention can be constructed in may different ways. Whilst the basic construction constituted by the profiling, cage, pressure plate and spring in successive arrangement remains the same, the position within the hinge and the association particularly of the profiling and the cage with respect to the individual hinge member is freely selectable. Use can be made of the hinge pin, i.e. it can be e.g. connected in non-rotary manner with the cage, if the hinge pin is mounted in non-rotary manner in the remote hinge member. These conditions will be made clear as a result of the embodiments described in greater detail hereinafter.

In particular a door hinge according to the invention can be selected in such a way that pre-assembly is possible, i.e. a complete aligning of the two hinge members, which can e.g. be detached again following the painting of the untreated body for completing the door separately from the vehicle, without it being necessary to lose the alignment made. This applies both for door hinges with an insertable and securable pin and for door hinges, whereof one hinge member is constructed in C-shaped manner. Account can also be taken of the accessibility of the hinge, e.g. with the aid of a power screwdriver from the inside in the case of automatic manufacture.

Embodiments of the invention are described in greater detail hereinafter relative to the drawings, wherein show:

DETAILED DESCRIPTION OF THE PREFERRED EMBODIMENTS

Figure 1:
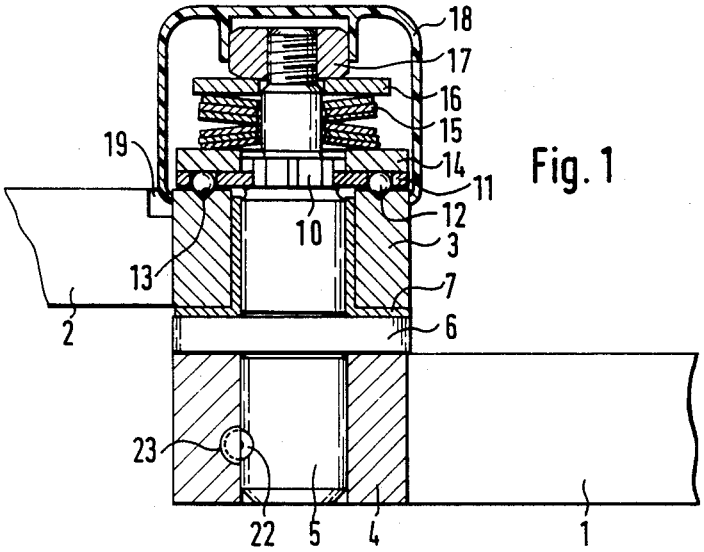
FIG. 1 A cross-sectional view through a hinge according to the invention in a first embodiment.

FIG. 1 shows a door hinge for a vehicle door, which essentially comprises a hinge member 1 associated with the door post and a hinge member 2 associated with the door. Both hinge members 1 and 2 are shaped to form an eye 3,4, in each of which is received a hinge pin 5. Between the two hinge members 1,2 is provided a flange 6 constructed integrally with the hinge pin 5. The pivotal mounting of the door member 2 to the post member 1 takes place with respect to said flange 6 and a journal of the hinge pin 5 connected at the top using a bearing bush 7, which is constructed as a flange bush. Thus, the hinge pin 5 is immovably fixed to the post member 1 in a manner to be explained hereinafter.

Above the journal serving as the actual bearing, the hinge pin 5 carries teeth 10, in which engages the inner teeth of a cage 11 with a slight clearance. The cage 11 is constructed as a substantially planar plate,, provided in uniformly spaced manner with three holes for receiving balls 12. The balls 12 form the retaining elements of the door check. Above the cage 11, but still in the vicinity of the teeth 10, is provided a pressure plate 14, which rests on the balls 12 with the aid of cup springs 15 having a certain biasing force. The biasing force of the cup springs 15 is applied by means of a nut 17 via a disk 16, which nut is screwed on to a thread on the upper, free end of hinge pin 5. The nut is prevented from turning after adjustment or setting by caulking or with the aid of a corresponding adhesive.

The thickness of the cage 11 is chosen in such a way that, even on the balls 12 being lowered into depressions 13 on the end face of the eye 3 associated with the door 2, the pressure plate 14 still has contact with the balls 12, i.e. the cage 11 is merely located with clearance or play between the end face of the eye 3 and the pressure plate 4. The cup springs 15 are centrally guided on a corresponding cylindrical portion below the thread for the nut 17 on the hinge pin 5.

If the door member 2 is turned with respect to the post member 1, the cage 11 and the post member 1 remain stationary, whereas the eye 3 of the door member 2 turns under the cage. The balls 12 rise up the inclines of the depressions 13 and press the pressure plate 14 in a greater distance with respect to the end face of the eye 3. As a result of the rolling movement, the pressure plate 14 is pivoted in the opposite direction and in proportion to the pivoting of the door member 2 with respect to the post member 1. Thus, a rotation takes place between the pressure plate 14 and the cup springs 15 or between the cup springs 15 and the disk 16 or between the disk 16 and the nut 17. This is not detrimental and indicates that a rolling arresting takes place by means of the balls 12.

The complete door check is covered in dust-tight and moisture-tight manner with the aid of a plastic cap 18, whose sealing lip engages in the upper part of the eye 3. For this purpose a corresponding recess 19 is provided in the flesh of the door member 2. The cap 18 can be filled with grease and at least the underlying moving components are lubricated with oil or grease.

Figure 2:
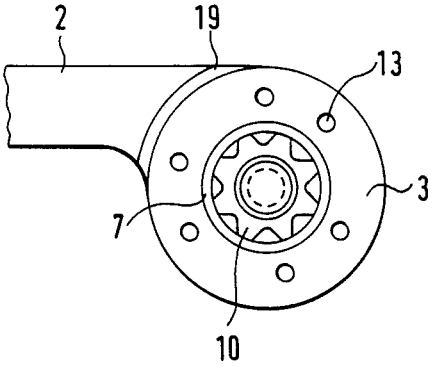
FIG. 2 A plan view of the pivotally mounted door member of the hinge according to FIG. 1.

FIG. 2 shows that there are in all 6 depressions in the end face of the eye 3, namely there are three depressions for each retaining position associated with a middle opening angle of the door, and there are another three depressions 13 for the maximum door opening position. The associated depressions have an angular distance of 120° against each other i.e. are uniformly distributed around the circumference.

The representation of FIG. 1 is consequently strictly speaking incorrect, in that two facing balls 12 are shown, but there is no depression and ball in the corresponding sectional plane. Thus, the representation of FIG. 1 has only been chosen for clarity reasons.

Particularly in the case of strong arresting forces, it is advantageous to adopt a special measure for retaining the rotatability of the pressure plate 14 according to FIG. 1. In such a case, the pressure plate 14 is replaced by a lower bearing ring 26 of a ball bearing 25, which inherently has the necessary hardness for the rolling of the retaining elements in the form of balls 12. As is diagrammatically indicated in FIG. 3, the set or assembly of the cup springs 15 then rests on the upper bearing ring.

Figure 3:
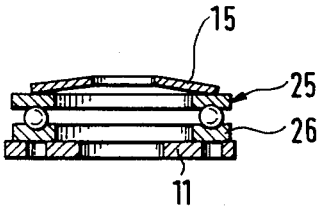
FIG. 3 A cross-sectional view in detailed form to illustrate a further embodiment for a pressure plate in the form of an axial ballbearing.

Obviously there can additionally be a pressure plate 14, but in general the solution shown in FIG. 3 is adequate. For the better guidance of dial ballbearing 25, it is possible to use a not shown sleeve, which is in turn centered by the outer face of the mulitooth profile 10.

The overall assembly of the hinge pin 5 within the eye 3 of the door member 2, including the door check above it beneath the cap 18, can take place completely detached from the post member 1.

For completing the hinge, the door hinge members are connected and the unit is fixed to the door or the vehicle body. Both members can still be separated at this point, because the hinge pin 5 has not been finally fixed within the post member 1. This possibility of a separation after the inital setting has taken place, offers advantages in the manufacture of the overall vehicle.

For the non-rotary anchoring of the hinge pin 5 within the post member 1, the pin 5 is provided at a predetermined point with a half-centering means 22, i.e. recessed in the manner of a half-cone frustum. Such a shape can be particularly easily obtained in that two hinge pins 5 are directly engaged with one another and spot drilled with a conventional centre drill with an opening angle of 60°.

At the same point a tapped hole 23 is made within the eye 4 of the post member 1 and into it can be screwed a screw with a 60° tip or point. If the hinge pin 5 has been inserted beforehand, provided that there has been a certain pre-positioning of the pin 5, the tip is drawn in clearance-free manner into the half-centring means on the pin shank, so that both non-rotation and non-axial displacement are ensured. The bottom of the tapped hole 23 is constructed as a half-centering means, so that a particularly tight or full engagement occurs. A hinge pin 5 secured in this way can be considered as a component integral with the post member 1 as regards strength.

Figure 4:
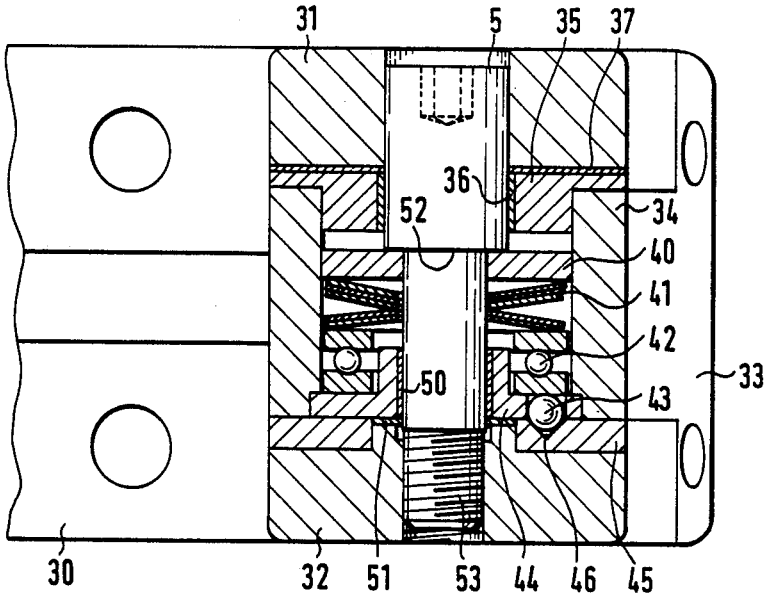
FIG. 4 A cross-sectional view through a further embodiment of a door hinge according to the invention.

FIG. 4 shows a hinge type, in which a C-shaped hinge member 30 with an upper arm 31 and a lower arm 32 embraces a central hinge member 33 on both sides. The articulated connection is once again brought about with the aid of a pin 5, which is screwed with the aid of a thread 53 into the lower arm 32 of the C-shaped hinge member 30. In this embodiment, the door check is located within a casing 34 formed by the central hinge member 33 and which is closed on its top side with the aid of a cover 35. At its side facing the pin 5, the cover 35 carries a bearing bush 36 and on the side facing the upper arm 31 a bearing disk 37. The cover 35 is immovably arranged in the case 34, i.e. is for example pressed or bonded in.

The cavity of the casing 34 contains a disk 40, displaceable in the longitudinal direction of pin 5, a set of cup springs 41 and an axial ballbearing 42. Its lower bearing ring serves as a pressure plate for the balls 43, i.e. for the retaining elements. This construction is fundamentally known from the description of the preceding embodiment through combining FIGS. 1 and 3. The cage 44 containing the three balls 43 (only one shown) which are uniformly distributed around the circumference is pressed in fixed manner into the casing 34 and is provided on its inside with a socket-like extension, within which is arranged a bearing bush 50. This cooperates with the fixed bolt 53 screwed into the C-shaped hinge member 30. The cage 44 serves to guide the balls 43 and to support the central hinge member 33 in the vicinity of the lower part of the casing 34.

The profile for forming the arresting means, e. g. on two points of the total door opening path, in the form of depressions 46 is located in a profile plate 45, which is mounted with a corresponding accuracy of fit on the inner end face of the lower arm 32 of the C-shaped hinge member 30. The profile plate 45 is fixed to said hinge member 30, i.e. is for example pressed on, bonded or additionally positively secured against rotation. This simplifies the manufacture of the profiling outside the hinge. Within the profile plate 45 is also fitted a bearing disk or plate 51, which axially controls the central hinge member 33 in the downwards direction.

It is clear that the bolt 5, without engaging with a stop, is screwed into the hinge at 53. The depth of screwing-in controls the desired biasing of the cup spring set 41 via a disk 40. For this purpose the bolt is provided with a shoulder 52, which carries along the disk 40 on screwing-in and a deeper screw down bolt 5 leads to a greater biasing of the cup springs 41. The screwing-in can be fixed geometrically or by a force measurement of the screwing-in torque. The bolt 5 is secured by an adhesive or other screw securing means, which is not shown. Through the variation of the screwing-in depth of the bolt 5, the door hinge shown in FIG. 4 can be used and/or readjusted for varyingly heavy doors. The upper end face of the pin 5 has an embedded hexagonal recess profile for the rotation of said pin.

It is pointed out the casing 34 and therefore the central hinge member 33 is not affected by the tension of the spring assembly 41, which is supported by means of the axial ballbearing 42 and the balls 43 on the lower arm 32 of the C-shaped hinge member 30. The rest for the spring assembly 41 in the form of the disk 40 is held by the shoulder 52 of the bolt 5, which is in turn anchored in the lower arm 32. The interposed cage 44 is sufficiently thin that even when the balls 43 are low down in depressions 46, the lower bearing ring of the ball bearing 42 does not press the cage 44 into the profile plate 45. Therefore the axial control face in the form of the bearing disk or plate 51 can be particularly small, because it merely has to carry the weight of the door.

In the embodiment shown in FIG. 5, there is once again a hinge, in which one hinge member 30 has a C-shaped construction and the other hinge member 33, as a so-called central hinge member is surrounded on both sides. The actual door check is located in the upper arm 31 of the C-shaped hinge member 30. The central hinge member 33 is mounted with the aid of a bearing bush 55 and a bearing disk 56 with respect to the hinge pin 5. There is a further bearing disk on the upper end face of the central hinge member 33. However, as stated hereinbefore, at this point there is virtually no engagement.

Within the casing 54 in the upper arm 31 of the C-shaped hinge member 30, there is once again the same construction as in the previously described embodiment, i.e. a cup spring set or assembly 41, an axial ballbearing 42 and three balls 43, which are guided within a cage in the form of a plate 44 provided with opening. The cage 44 is firmly pressed into the casing. On the radius of the balls 43 are provided depressions 46 at corresponding points within the central hinge member 33, so that the above explained arresting action occurs.

To adjust the bias of the cup spring assembly 41, the hinge pin 5 is provided with a head 57, which in the screwed-in position rests on a seat at the upper end of the casing 54. Thus, the bias is fixed by geometrical conditions. The pin 5 can be screwed into this position with the aid of a pin-type wrench.

The bias or load of the cup springs 41 in the case of a modified, not shown construction, can also be made freely selectable by screwing-in to a different depth. The head 57 is then secured in the desired position and does not engage on the seat at the upper end of case 54. Alternatively using not shown shims, varying screwing-in depths can be obtained between the head 57 and the casing. Another modification for obtaining a given screwing-in depth can be obtained through a conical seat and a cone portion-like outer face of the head 57. Thus, there is a definite centering at the upper end of the pin 5.

The load of the cup springs 41 acts via the axial ball-bearing 42 and the balls 43—once again there are three balls uniformly distributed over the circumference—on the central hinge member 33, so that the central hinge member is pressed against the lower arm 32 of the C-shaped hinge member 30. Therefore there are virtually no axial bearing forces between the central hinge member 33 and the upper arm 31 of the C-shaped hinge member and reference was made to this hereinbefore.

It is also possible to provide between the individual hinge members seals, e.g. in the lower end face of the casing 34 outside the cage 44 in the embodiment according to FIG. 4 a groove can be provided for receiving an O-ring. The same applies with regards to the downwardly directed end face of the casing 54 in the embodiment according to FIG. 5. Those partial faces between which there is a bearing disk or plate generally require no sealing, because the bearing disk fulfils this function.

It is obvious that e.g. the profile plate in the embodiment according to FIG. 4 is at least surface-hardened, because there is a constant rolling friction with relatively high specific pressures. In the embodiment according to FIG. 5 the corresponding region is case or induction hardened, so that the toughness and strength of the particular hinge member is substantially fully retained. The balls 43 or 12 are conventional antifriction bearing balls, which have inherently the necessary hardness.

Figure 5:
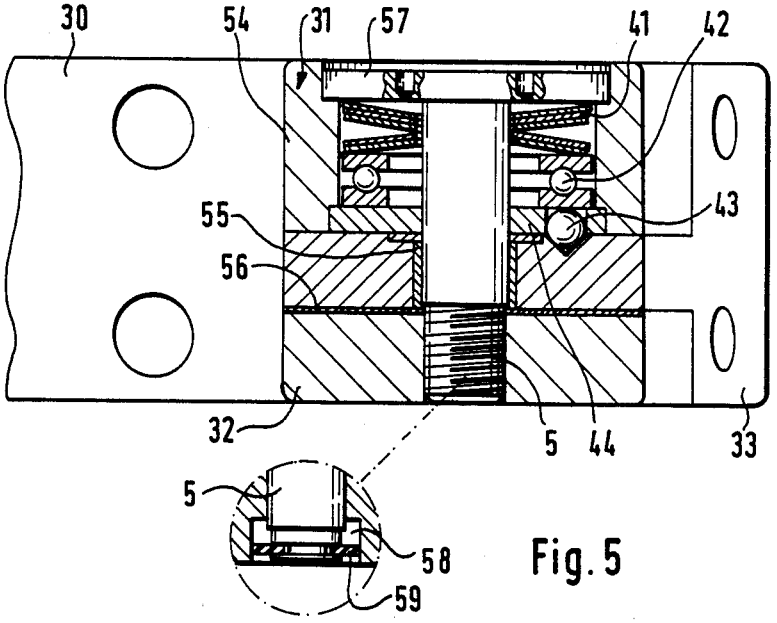
FIG. 5 A cross-sectional view according to FIG. 4 of a third embodiment for a door hinge according to the invention.

A modified form of the pin 5 is shown within a drawn out circle in FIG. 5. It is used in conjunction with a recess 58 in the underside of the lower arm 32 of the C-shaped hinge member 30. An elastomer disk 59 is inserted in a groove made on the outermost pin end which is, in the shown rest position, approximately flat and seals the recess 58 and consequently the thread above it. The elastomer disk 59 is sufficiently elastic to ensure that on unscrewing the pin 5 it forms a sleeve around the pin in this reduced diameter area of the pin and consequently is drawn as a cap-like member through the thread. As soon as the elastomer disk 59 has reached the cage 44, the difficult action prevailing ring the crossing of the bush 55 continues, so that in this position the pin releasing the hinge member 33, is held in the upper arm 31 of the hinge member 30.

On screwing down again, the elastomer disk 59 which has become deformed to give a cap-like sleeve pops over and again follows the pressing or screwing-in movement until the elastomer disk 59 can deform back to a disk-like configuration within the recess 58. This leads both to a sealing of the thread for the duration of painting and the subsequent operation, as well as a clamping facility for the unscrewed pin 5 to the extent necessary for the separation of the hinge. The elastomer disk can obviously be replaced by a metal tongue or a spring-loaded ball in radial form in the front part of the pin thread. Admittedly this does not provide a thread sealing, but a temporary clamping of the pin in the separated state is readily achievable.

The inventive hinges, independently of the construction, are preferably fitted to the lower of the two hinges for a vehicle door, because this mounting point only has a small distance from the rigid floor section and consequently the most favourable conditions exist at this point for a secure mounting. As in this area doors often have a so-called drop, i.e. are drawn in towards the vehicle centre, the hinge according to the invention can be adapted to said door contour by a corresponding chamfer or bevel (not shown). This chamfer or bevel is machined only into so-called solid parts, e.g. the outer areas of arms 31, 32 and the central hinge part 33.

It is obviously possible to interchange constructional details of the individual embodiments, provided that the function is retained. For example, in the embodiment according to FIG. 5, the profile in the central hinge member 33 can also be stamped into a separate plate, which is then firmly anchored at this point, which is also described in conjunction with the embodiment according to FIG. 4.

In the embodiment according to FIG. 5, the hinge pin 5 is firmly screwed into the thread in the lower arm 32 of the C-shaped hinge member 30. Thus, the pin 5 has a resistance when the head 57 touches the seat, so that the thread can be tightened in the usual way. In the embodiment according to FIG. 4 the hinge pin simultaneously constitutes a control element for biasing the cup springs, so that the thread loading is limited. As a further development, it is proposed for the embodiment according to FIG. 5, that the internal thread in the C-shaped hinge member 30 is constructed a so-called spiral lock thread, i.e. as an internal thread with cone-like faces in the root of the thread and which have a self-locking action. Corresponding tools are marketed by Emuge-Werke Richard Glimbel in the Federal Republik of Germany.

I claim:

1. A door hinge for a vehicle door, with a hinge member associated with a post member, with another hinge member associated with a door members, and member, with a hinge pin pivotally connecting the two hinge with a door check for temporarily arresting the door in at least one opening position, comprising a profile formed on one hinge member and at least one spring-loaded retaining ball held on the other hinge member to be moved synchronously therewith, and cooperating with said profile, said profile comprising at least one depression in one end face on said one hinge member, and retaining ball being surrounded by a cage connected in a non-rotary manner to said other hinge member, said cage connected to pin said other hinge member directly or via said hinge pin, said hinge fixedly secured in said other hinge member, each said at least one retaining ball engaging on a spring-loaded, freely rotatable pressure plate, said pressure plate elastically supported by supported by at least one cup spring, said pressure plate constitute one bearing ring of an axial ball bearing with said cup spring acting on another bearing ring.

2. Door hinge according to claim 1, wherein the cage is a plate with the same number of openings as there are retaining balls.

3. Door hinge according to claim 2, wherein each depression is a cone.

4. Door hinge according to claim 3, wherein a plurality of balls and cones are provided for the arresting.

5. Door hinge according to claim 1, wherein both hinge members are provided with a conventional stop for limiting the opening angle.

6. Door hinge according to claim 1, wherein the hinge member carrying the profile is mounted in a rotationally movable manner about the hinge pin inserted and anchored in the other hinge member and the cage is held in non-rotary manner on the hinge pin on the side remote from the other hinge member.

7. Door hinge according to claim 6, wherein for the non-rotary securing of the cage with respect to the hinge pin a multitooth profile is provided.

8. Door hinge according to claim 3, wherein the springs are biased by a lockable nut on the free end of the pin.

9. Door hinge according to claim 8, wherein the hinge pin is provided with a flange on which the pivotally mounted hinge member engages.

10. Door hinge according to claim 6, wherein for the non-rotary anchoring of the hinge pin, there is a half-centering means below the flange in the other hinge member of the pin shank and the hinge member carries a tangential tapped hole for receiving a screw provided with a centering tip.

11. Door hinge according to claim 10, wherein the complete door check is covered by a cap and is encapsulated in grease-proof manner.

12. Door hinge according to claim 1, wherein the one hinge member embraces the other central member in C-shaped manner, the profile is arranged on the inside of one arm of the C-shaped hinge member and the cage including the pressure plate and spring are housed in the central hinge member.

13. Door hinge according to claim 12, wherein the rest of the spring is a disk movable in the longitudinal direction of the hinge pin and guided in the central hinge member and the pin is provided with a shoulder, so that its screwing-in depth determines the position of the disk and therefore the strength of the biasing force of the retaining elements.

14. Door hinge according to claim 13, wherein the cage is fixed to the central hinge member and is covered with a bearing material or carries a corresponding bush and plate for guiding the hinge pin and the facing arm of the C-shaped hinge member.

15. Door hinge according to claim 1, wherein tee one hinge member embraces the other central member in C-shaped manner, the profile is arranged on one side of the central hinge member and the cage including pressure plate and spring, are housed in an arm of the C-shaped hinge member.

16. Door hinge according to claim 15, wherein the rest of the spring is a head connected to the hinge pin, so that its screwing-in depth into the thread in the other arm determines the bias force of the retaining elements.

17. Door hinge according to claim 3, wherein each opening of the cage is provided with a constriction on at least one side facing the profile to prevent the balls to drop out.

18. Door hinge according to claim 1 wherein each retaining element is a tapered roller and each depression is a radial groove.

19. Door hinge according to claim 1, wherein each depression is connected in substantially continuous manner to the adjacent depression for achieving an arresting action in virtually any pivoting position.

20. Door hinge according to claim 1 wherein the depression or depressions associated with the maximum door opening angle are provided with a deep step over which the retaining element cannot roll thus providing an end stop.

21. Door hinge according to claim 12 or 15, wherein the cavity for receiving the pressure plate and the spring is formed by a blind bore in the central hinge member or in an arm of the C-shaped hinge member, whose end face forms the cage.

22. Door hinge according to claim 18, wherein the head has a conical portion-like circumferential surface and the engagement face in one arm of the C-shaped hinge member is also conical.

23. Door hinge according to claim 1, wherein the profile is formed into a separate component.

24. Door hinge according to claim 1, which carries a flattened portion to take account of the door drop.

25. Door hinge according to claim 16, wherein at the free end of the pin thread there is a tongue, a spring-mounted ball or an elastic disk for locking engagement with the cage upon unscrewing the pin so much that the hinge members can be separated.

26. Door hinge according to claim 16, wherein the thread in the other arm of the C-shaped hinge member is constructed as a spiral lock thread.

27. Door hinge according to claim 26, wherein the spiral lock thread is constructed with cone-like faces in its thread root for avoiding a radial movement of the screwed-in pin.

* * * * *